United States Patent [19]

Rudszinat

[11] 4,201,102

[45] May 6, 1980

[54] APPARATUS FOR SUBDIVIDING RUNNING WEBS INTO SECTIONS OF VARYING LENGTH

[75] Inventor: Willy Rudszinat, Dassendorf, Fed. Rep. of Germany

[73] Assignee: Hauni-Werke Korber & Co., KG, Hamburg, Fed. Rep. of Germany

[21] Appl. No.: 954,093

[22] Filed: Oct. 24, 1978

[30] Foreign Application Priority Data

Nov. 4, 1977 [DE] Fed. Rep. of Germany ..... 2749363

[51] Int. Cl.[2] ..... B26D 5/20

[52] U.S. Cl. ..... 83/298; 83/324

[58] Field of Search ..... 83/38, 298, 299, 324, 83/593

[56] References Cited

U.S. PATENT DOCUMENTS

| | | | |
|---|---|---|---|
| 2,879,845 | 3/1959 | Haas | 83/324 X |
| 3,742,798 | 7/1973 | Gries | 83/324 X |
| 3,745,865 | 7/1973 | Johnson | 83/324 X |
| 3,962,942 | 6/1976 | Ferara | 83/324 X |

*Primary Examiner*—J. M. Meister

*Attorney, Agent, or Firm*—Peter K. Kontler

[57] ABSTRACT

Apparatus for severing a running web at different intervals to subdivide the web into sections of desired length has two advancing rolls which transport the web lengthwise at a constant speed toward the nip of two rotary cutters having blades which sever the web in predetermined angular positions of the cutters. The cutters are driven in opposite directions by a stepping motor which receives stepping signals at a first frequency when the blades are about to sever and while the blades sever the web to thereby rotate the cutters at the speed of the web, and at any one of different second frequencies in other angular positions of the cutters. The system which transmits stepping signals has an exchangeable indicia-bearing disk which is driven by the advancing rolls through the medium of a variable-speed transmission or through one of several transmissions having different ratios. The indicia on the disk include a first group which is detected by a signal generator while the blades are about to sever and while the blades sever the web, and a second group of indicia which are detected by the signal generator during intervals between successive movements of blades to the cutting positions. By replacing the disk with a disk having different groups of first and second indicia and by changing the ratio or the transmission or by replacing the transmission with a transmission having a different ratio, the operator can change the distance between successive cuts.

10 Claims, 1 Drawing Figure

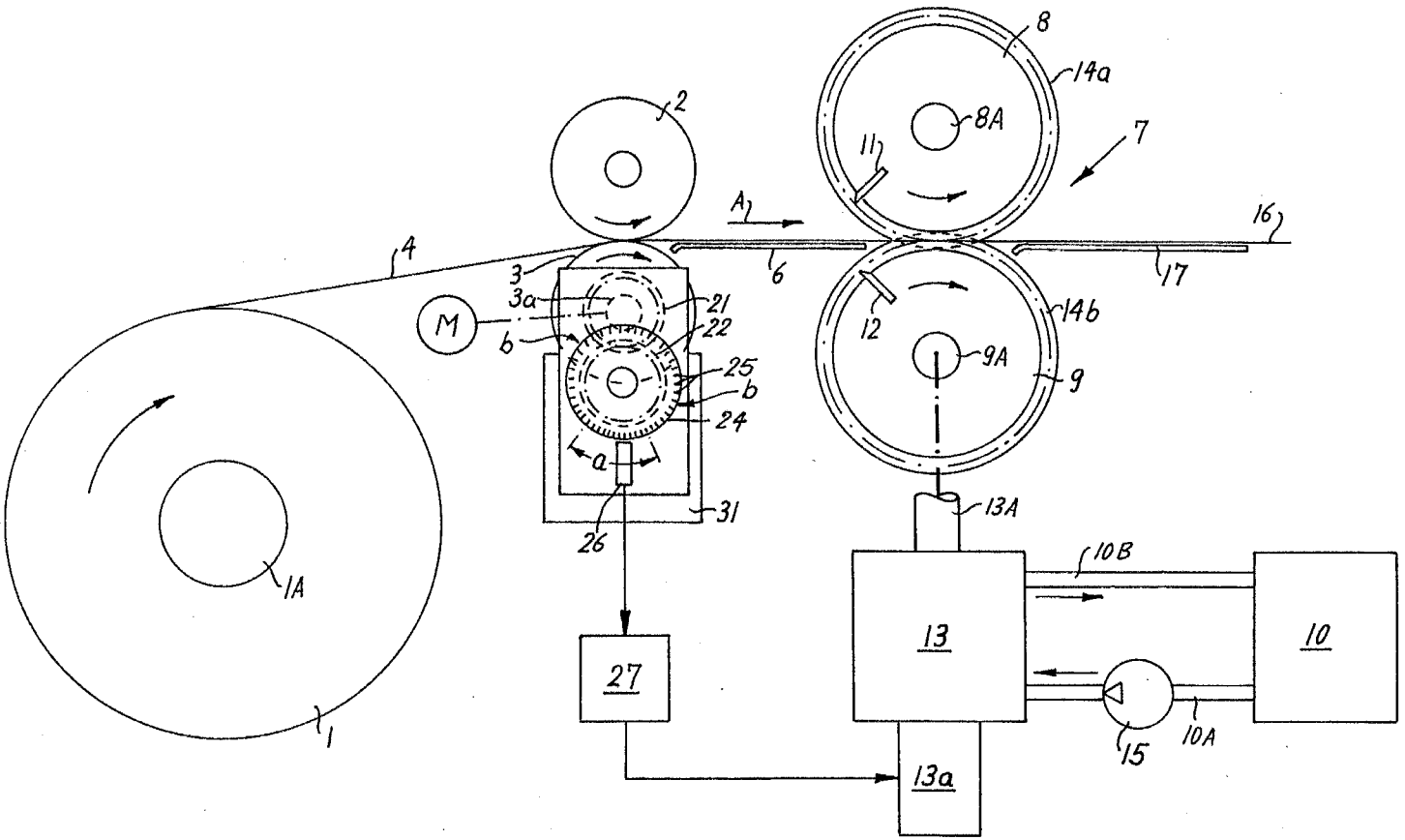
10
10A
15
10B
13
13a
13A
16
17
7
14a
14b
8
9
8A
9A
11
12
A
6
2
21
22
25
b
24
31
26
a
27
3
3a
b
M
4
1
1A

APPARATUS FOR SUBDIVIDING RUNNING WEBS INTO SECTIONS OF VARYING LENGTH

BACKGROUND OF THE INVENTION

The present invention relates to apparatus for severing webs which consist of paper, cardboard, synthetic plastic material, metallic foil or the like. More particularly, the invention relates to improvements in apparatus for subdividing a running web into sections of desired length, i.e., for severing the web at any one of several frequencies so that the web yields shorter, medium-long or longer sections which can be utilized to form stacks of overlapping leaves or sheets, to constitute blanks for use in the manufacture of cigarette packs or other types of containers for smokers' products, or for other purposes.

It is known to sever a running web of paper or the like by a rotary center which is adjacent to the path of movement of the web and has one or more blades serving to cut across the web at desired intervals. The cutter is driven at a peripheral speed which is identical with the speed of forward movement of the web. Severing apparatus of the just outlined character are known as concurrent cutting devices. They are used in many fields, such as for subdivision of paper webs into sheets or leaves which are thereupon stacked to form note books or pads, in filter cigarette making machines to subdivide adhesive-coated webs into bands which serve to unite plain cigarettes, cigarillos or cigars with filter mouthpiece, in packing machines for cigarettes or the like to subdivide webs of metallic foil, paper, synthetic plastic material or cardboard into blanks which are converted into components of packets, in labelling devices to subdivide a ribbon of labels into discrete labels (e.g., revenue labels for application to cigarette packs) and for a host of other related or unrelated purposes.

A drawback of presently known severing apparatus is that they cannot be readily adjusted when the length of sections which are obtained in response to subdivision of a running web must be changed. Such adjustments are necessary in many industries, e.g., in the tobacco processing industry when the manufacture decides to make cigarette packs of different size and/or shape or when the manufacturer must apply revenue labels whose dimensions deviate from the dimensions of previously used labels. It is also desirable to employ a versatile severing apparatus which can subdivide a relatively wide ribbon, web or strip into sheets or leaves of any desired size. Presently known severing apparatus do not meet such requirements because the intervals of time which elapse during each change of setup are long and the operation is complex, i.e., it must be performed by skilled persons. Moreover, each change in setup involves replacement and adjustment of a substantial number of parts.

OBJECTS AND SUMMARY OF THE INVENTION

An object of the invention is to provide a versatile severing apparatus for running paper webs or the like which can be adjusted to subdivide a running web into sections of any desired length with little loss in time and in a simple and economical way.

Another object of the invention is to provide a severing apparatus which can be adjusted to subdivide a running web into sections of desired length without appreciable dismantling and by resorting to semiskilled or even unskilled labor.

A further object of the invention is to provide novel and improved means for transmitting motion to the severing instrumentality or instrumentalities of the above outlined apparatus.

An additional object of the invention is to provide an apparatus which can be used to sever a running a web at a high frequency such as is necessary when the apparatus is installed in a high-speed machine for the processing of smokers' products, paper sheets or the like.

Another object of the invention is to provide the apparatus with novel and improved means for establishment of an operative connection between the web advancing and severing instrumentalities.

A further object of the invention is to provide an apparatus of the above outlined character which can be installed in existing web processing machines as a superior (especially simpler and more versatile) substitute for existing severing apparatus.

The invention is embodied in an apparatus for severing a running web, strip or ribbon (hereinafter called web) at variable intervals to thereby subdivide the web into sections (e.g., blanks, leaves, labels or the like) of desired length. The apparatus comprises a pair of driven rolls, drums or analogous means for advancing the web lengthwise along a predetermined path and at a predetermind speed, at least one rotary cutter adjacent to the path and having means (e.g., a single blade or knife which extends transversely of the path) for severing the web in at least one predetermined angular position of the cutter, and novel and improved means for driving the cutter. The driving means comprises a signal-responsive variable-stepping-rate stepping motor (preferably a fluid powered stepping motor, e.g., a motor of the type disclosed in U.S. Pat. No. 3,661,059 to Hunter et al., in U.S. Pat. No. 4,068,560 to Orloff et al. or in U.S. Pat. No. 4,066,002 to Eastman) having output means operatively connected with the cutter, and means for controlling the stepping rate of the motor. The controlling means includes means for transmitting to the motor signals at a first frequency in the predetermined angular position of the cutter to thereby rotate the cutter at the predetermined speed (i.e., at the speed of lengthwise movement of the web) and at a selected one of a plurality of second frequencies to thereby rotate the cutter at a selected one of a plurality of second speeds which deviate from the predetermined speed in other angular positions of the cutter so that the interval which elapses between two successive movements of the cutter to the predetermined angular position is a function of the selected second frequency.

The signal transmitting means preferably comprises a rotary element (e.g., a disk which is provided with photoelectrically detectable indicia) and the controlling means further comprises a variable-speed transmission, a fixed-ratio transmission or analogous means for rotating the element at a speed which is proportional to the predetermined speed. The transmission connects the advancing means with the rotary element, and the element is preferably provided with a first group of equidistant indicia and with a seond group of indicia having (at least in part) a spacing which is different from the spacing of indicia constituting the first group. The signal transmitting means further comprises a photocell or other suitable signal generating means which monitors the indicia and is adjacent to the rotary element to transmit signals at the first frequency on detection of indicia of the first group and at one of the second frequencies on detection of indicia of the second group.

The signal transmitting means further comprises one or more spare rotary elements having first and second groups of indicia in a distribution other than that of indicia on the first mentioned rotary element. Such spare elements can be installed in the controlling means in place of the previously employed rotary element, and the transmission ratio of the variable speed transmission is changed accordingly (or the transmission having a fixed ratio is replaced with a transmission having a different fixed ratio) when the operator desires to change the distance between successive cuts across the running web.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a partly elevational and partly diagrammatic view of an apparatus which embodies one form of the invention and wherein the running web is severed by two rotary cutters.

DESCRIPTION OF THE PREFERRED EMBODIMENTS

The apparatus which is shown in the drawing comprises a frame or housing supporting a spindle 1A for a bobbin 1 which constitutes a source of supply of an elongated flexible web 4. The web 4 may consist of paper, synthetic plastic material, cardboard or metallic foil. The apparatus further comprises two advancing rolls 2 and 3 which transport the web 4 lengthwise in the direction indicated by arrow A. The elongated path for the web 4 is defined in part by two guides 6 and 17 which are respectively located upstream and downstream of a severing unit 7 including two rotary cutters each having a holder (8, 9) for a knife or blade (11, 12). The means for rotating the holder 8 of the upper cutter (as viewed in the drawing) comprises two mating gears 14*a*, 14*b* which are respectively affixed to shafts 8A and 9A. The web 4 is severed whenever the blades 11, 12 respectively assume or are close to the six o'clock and twelve o'clock positions, i.e., once during each revolution of the holders 8 and 9. These holders rotate at identical speeds but in opposite directions and face each other at the opposite sides of the path portion between the guides 6 and 17.

The means for driving the advancing rolls 2 and 3 (preferably at a constant speed) comprises a motor M whose output element rotates the shaft 3*a* of the roll 3. The roll 2 can receive torque from the shaft 3*a* or is simply biased against the roll 3 in a manner well known from the art of transporting webs in tobacco processing or like machines.

The severing unit 7 is a so-called concurrent severing unit, and the shaft 9A of its knife holder 9 is driven by the output element 13A (indicated in part by phantom lines) of a stepping motor 13, preferably an electrohydraulic nutating motor arranged to drive the knife holders 8 and 9 at a speed which varies in different angular positions of the holders. The knife holders 8 and 9 are rotated at a peripheral speed which matches the speed of lengthwise movement of the web 4 when the knives 11 and 12 approach, move past and advance slightly beyond the adjacent portion of the path for the web, i.e., the nip of the holders 8 and 9.

The exact construction of the stepping motor 13 forms no part of the invention. This motor is preferably designed in such a way that it rotates the output element 13A through a predetermined angle in response to each signal which is transmitted to its starting unit 13*a*. The motor 13 receives fluid (e.g., a hydraulic fluid) from a reservoir 10 via conduit 10A which contains a pump 15, and the motor 13 returns spent fluid into the reservoir 10 via conduit 10B.

The knives 11 and 12 sever the running web 4 at selected intervals so that the web 4 yields a succession of discrete sections or blanks 16 which advance along the guide 17 to a further processing station, e.g., to a stacker or to a paster which coats one side of each section 16 with a suitable adhesive if the sections are to be used as uniting bands for plain cigarettes and filter mouthpieces in filter tipping machines. Alternatively, the sections 16 may constitute blanks which are to be converted into inner, median or outer envelopes of soft or flip-top packs for blocks of cigarettes or other smokers' products. The destination of sections 16 and the manner in which such sections are further processed or stored form no part of the invention.

The means for driving the cutter including the holder 9 and its knife 12 includes the aforediscussed stepping motor 13 and means for controlling the stepping rate of the motor, i.e., the frequency at which the starting unit 13*a* of the motor 13 receives electric signals which initiate angular displacements of the output element 13A through angles of identical magnitude. The controlling means includes a transmission here shown as including two removable mating gears 21 and 22 the former of which is affixed to the shaft 3*a* of the advancing roll 3 and the latter of which is coaxial with and serves to rotate an indicia-bearing element in the form of a disk 24. The indicia 25 are graduations which are detected by a monitoring device here shown as a photocell 26 which is adjacent to the disk 24. The signals which are generated by the photocell 26 are preferably amplified in a manner not specifically shown in the drawing and transmitted to a pulse shaper 27 which, in turn, transmits signals to the starting unit 13*a* of the stepping motor 13.

The number of indicia or graduations 25 on the disk 24 equals the number of steps which the motor 13 must complete in order to rotate the knife holders 8 and 9 through one revolution. If the transmission ratio between the output element 13A and the holders 8, 9 is one-to-one, the rotor of the motor 13 completes one revolution in response to each revolution of the disk 24. The latter may consist of transparent material (e.g., glass) which allows for the application of a large number of indicia to one or both of its major surfaces. A disk which consists of glass can accommodate a very large number of closely adjacent graduations even if the diameter of the disk is relatively small.

The disk 24 includes a portion or zone a wherein the indicia or graduations 25 form a first group of equidistant indicia. The photocell 26 detects such indicia while the knives 11 and 12 approach, move past and slightly beyond the severing station at the nip of the holders 8 and 9. The distances between neighboring indicia 25 in the zone a are such that the peripheral speeds of the holders 8 and 9 match the speed of lengthwise movement of the running web 4 when the starting unit 13*a* receives signals which are generated by the photocell 26 on scanning of indicia in the zone a. It is assumed, of course, that the motor M drives the advancing rolls 2 and 3 at a constant speed.

The indicia 25 in the other zone b of the disk 24 are distributed in a different way; their spacing may be greater (this is shown in the drawing) or less than the spacing or neighboring indicia in the zone a. As shown in the drawing, the spacing between neighboring indicia 25 in the zone b varies at a constant rate. Looking clockwise, the spacing between indicia 25 to the left of the zone a increases gradually beyond that between the indicia of the zone a to a maximum spacing at the twelve o'clock position of the disk 24, and thereupon decreases gradually toward the right-hand side of the zone a so that the spacing of indicia in the zone b at the five o'clock position of the disk 24 equals or very closely approximates the spacing of indicia in the zone a. Continuous variation of spacing between indicia 25 in the zone b exhibits the advantage that the stepping rate of the motor 13 does not undergo any abrupt changes during movement of knives 11, 12 away from and again back toward the severing station. Of course, the distribution of indicia 25 in the zone b of the disk 24 can be selected in any other way, even with abrupt transition from the zone a into the zone b and back to the zone a, or with gradual transition at both ends of the zone a and with uniform distribution in the major part of the zone b, depending on the design of the stepping motor and other parameters.

The transmission 21, 22, the disk 24, the photocell 26 and the pulse shaper 27 together constitute the aforementioned means for controlling the stepping rate of the motor 13. Such controlling means is designed in such a way that the starting unit 13*a* of the motor 13 can receive signals at any one of a number of different frequencies including first frequencies when the photocell 26 monitors the zone a of an indicia-bearing element and second frequencies when the photocell generates signals on detection of indicia in the zone b of the indicia-bearing element. To this end, the apparatus comprises a frame 31 which supports the gear 22 and the disk 24 and can be replaced with another frame (not shown) supporting a different transmission component and a disk with indicia in a distribution other than the distribution of indicia on the illustrated disk 24. When the frame 31 is detached, the gear 21 is readily accessible for removal and replacement with a different gear. A second frame 31 is then installed in proper position so that its gear (corresponding to the gear 22) meshes with the newly mounted gear (corresponding to the gear 21) on the shaft 3*a*. As mentioned above, such second frame supports a disk wherein the distribution of indicia in the zone a and/or b is different from the distribution of indicia on the illustrated disk 24. The frame 31 will be replaced with another frame when the operator wishes to change the length of the sections 16, i.e., the length of intervals during which each of the knife holders 8, 9 completes a full revolution. The number of indicia on the freshly inserted disk is the same as on the disk 24; this insures that each revolution of the disk entails a complete revolution of each of the knife holders 8 and 9. The spacing between indicia in the zone a of the freshly inserted disk is uniform but not the same as that of indicia 25 in the zone a of the illustrated disk 24. The spacing of indicia in the zone b of the freshly inserted disk is also different. If the number of indicia in the zone a of the fresh disk exceeds the number of indicia in the zone a of the illustrated disk 24, the number of indicia in the zone b of the freshly inserted disk is less than the number of indicia in the zone b of the disk which is shown in the drawing.

The operation is as follows:

The motor M drives the advancing rolls 2 and 3 at a constant speed so that the web 4 advances at a constant speed in the direction of arrow A. The knives 11, 12 sever the web 4 once during each revolution of the holders 8 and 9 whereby the web 4 yields a succession of discrete sections 16 which advance along the guide 17. The ratio of transmission including the gears 21 and 22 is selected in such a way that the frequency at which the disk 24 presents successive increments 25 in the zone a to the photocell 26 enables the motor 13 to rotate the holders 8 and 9 at a peripheral speed which matches the speed of lengthwise movement of the web 4 while the knives 11 and 12 approach, move past and slightly beyond the severing station at the nip of the holders.

Once the knives 11 and 12 advance beyond the severing station, the photocell 26 begins to transmit signals at a second frequency which is determined by mutual spacing of indicia 25 in the zone b of the continuously rotating disk 24. Thus, the frequency gradually decreases to a minimum frequency and thereupon gradually increases to match the first frequency when the photocell 26 again monitors indicia 25 in the zone a. The disk 24 rotates at a constant speed because the motor M rotates the advancing roll 3 at a constant speed. Thus, the peripheral speed of holders 8 and 9 fluctuates in different angular positions of the knives 11 and 12 but such peripheral speed always matches or very closely approximates the speed of lengthwise movement of the web 4 when the knives 11 and 12 are at the severing station.

If the operator thereupon decides to change the length of sections 16, i.e., to change the distance between two successive transverse cuts, the frame 31 is removed (i.e., the gear 22 is detached from the gear 21 and the disk 24 is also removed) and the gear 21 on the shaft 3*a* is replaced with a different gear. The operator thereupon attaches a selected second frame with a gear corresponding to the gear 22 and with a disk which is driven by the freshly inserted gears and carries indicia in a different distribution. The ratio of the freshly mounted transmission (gears replacing the gears 21 and 22) is selected in such a way that it determines the length of sections 16 which are to be formed when the motor M is started again. Thus, if the length of sections 16 is to be reduced, the interval which elaspes during one revolution of the freshly inserted disk is longer and vice versa. The distances between neighboring equidistant indicia in the zone a of the freshly inserted disk are selected as a function of the ratio of freshly inserted transmission so that the knives 11 and 12 advance at the speed of the web 4 when they approach, move past and slightly beyond the severing station. When the photocell 26 monitors indicia in the zone b of the freshly inserted disk, the speed of the holders 8 and 9 varies; however, and as mentioned above, the total number of indicia on each of the disks is the same to insure that the rotor of the motor 13 turns through 360 degrees in response to each revolution of the disk. This means that the knife holders 8 and 9 also complete one revolution during each revolution of the freshly inserted disk provided, of course, that the transmission ratio between the output element 13A and the shaft 9A is one-to-one.

The gears 21 and 22 can be replaced with an infinitely variable-speed transmission which is simply adjusted whenever a disk 24 is replaced with a different disk. In other words, by resorting to a variable-speed transmission, one can employ a battery of frames 31 each of which merely carries a disk but need not carry a gear. The variable-speed transmission is adjusted prior or subsequent to insertion of a fresh disk.

The purpose of the transmission 21, 22 or an equivalent transmission (e.g., the aforementioned variable-speed transmission) is to drive the graduated disk 24 is synchronism with the advancing rolls 2 and 3. The term "synchronism" is intended to denote that the RPM of the disk 24 is proportional to the speed of lengthwise movement of the web 4, i.e., the peripheral speed of the disk 24 may but need not be identical with the speed of the web.

An important advantage of the improved apparatus is that the apparatus can be converted for subdivision of a running web into shorter or longer sections in an extremely simple, inexpensive and time-saving manner. Thus, if the graduated risk 24 is driven by a variable-speed transmission, each adjustment merely involves replacement of the disk 24 with a disk bearing graduations in a different distribution and an appropriate adjustment of the variable-speed transmission. If the transmission between the advancing means and the disk 24 has a fixed ratio, the adjustment involves replacement of such transmission with a different transmission. However, the advancing means and/or the severing means need not be adjusted, dismantled or otherwise manipulated when the operator decides to change the length of sections 16, i.e., the distance between successive transverse cuts across the running web 4.

It goes without saying that the apparatus can operate with a single knife and that the other holder then merely constitutes an anvil for the cutting edge of the knife. Also, by modifying the signal transmitting means, the apparatus can be designed in such a way that the web is severed twice or more often during each revolution of the knife holders 8 and 9.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for severing a running web at variable intervals to subdivide the web into sections of desired length, comprising means for advancing the web lengthwise along a predetermined path at a predetermined speed; at least one rotary cutter adjacent to said path and having means for severing the running web in at least one predetermined angular position thereof; and means for driving said cutter including a signal-responsive variable-stepping-rate stepping motor having output means operatively connected with said cutter and means for controlling the stepping rate of said motor, including means for transmitting to said motor signals at a first frequency in said predetermined angular position of said cutter to thereby rotate the cutter at said predetermined speed and at a selected one of a plurality of second frequencies to thereby rotate said cutter at a selected one of a plurality of second speeds in other angular positions of said cutter so that the interval of time which elapses between two successive movements of said cutter to said predetermined angular position is a function of the selected second frequency.

2. The apparatus of claim 1, wherein said signal transmitting means comprises a rotary element and means for rotating said element at a speed which is proportional to said predetermined speed.

3. The apparatus of claim 2, wherein said rotating means comprises a transmission connecting said advancing means with said rotary element.

4. The apparatus of claim 2, wherein said element has a first group of equidistant indicia and a second group of indicia having a spacing different from the spacing of indicia of said first group, said signal transmitting means further comprising signal generating indicia monitoring means adjacent to said element and operative to transmit signals at said first frequency on detection of indicia of said first group and at one of said second frequencies on detection of indicia of said second group.

5. The apparatus of claim 4, wherein said signal transmitting means further comprises at least one additional rotary element insertable into said controlling means as a substitute for said first mentioned element and having indicia whose distribution deviates from the distribution of indicia on said first mentioned element, and means for rotating said second element at a speed which is different from the speed of said first mentioned element, said last mentioned rotating means being insertable into said controlling means as a substitute for said first mentioned rotating means.

6. The apparatus of claim 2, wherein said rotating means comprises a variable-speed transmission.

7. The apparatus of claim 1, wherein said stepping motor is a fluid-powered motor.

8. The apparatus of claim 1, wherein said cutter is located at one side of said path and further comprising a second cutter located at the other side of said path opposite said first mentioned cutter, and means for rotating said second cutter at the speed of said first cutter but in the opposite direction.

9. The apparatus of claim 1, wherein said controlling means includes at least one transmission having an input element receiving torque from said advancing means.

10. The apparatus of claim 9, wherein said transmission is a removable gear transmission.

* * * * *